US005931429A

United States Patent [19]

Hellwig et al.

[11] Patent Number: 5,931,429

[45] Date of Patent: Aug. 3, 1999

[54] WORK SURFACE SUPPORT ARRANGEMENT FOR OFFICE PANELLING SYSTEMS

[75] Inventors: John Hellwig, Toronto; Steve Verbeek, Aurora; Lorie Marangoni, Weston, all of Canada

[73] Assignee: Teknion Furniture Systems Limited, Canada

[21] Appl. No.: 08/843,144

[22] Filed: Apr. 28, 1997

[51] Int. Cl.[6] ..... A47G 29/02

[52] U.S. Cl. ..... 248/235; 248/220.22; 248/188.8; 108/108; 52/36.6

[58] Field of Search ..... 248/235, 243, 248/245, 225.1, 125.3, 188.8, 223, 220.21, 220.43, 221.11, 236, 237, 238, 220.22; 211/90, 87, 183, 103, 94.1, 90.1, 187; 52/36, 36.1, 36.4, 36.6, 36.5, 239; 108/44

[56] References Cited

U.S. PATENT DOCUMENTS

| | | | |
|---|---|---|---|
| 3,353,684 | 11/1967 | Chesley | 211/187 |
| 4,881,471 | 11/1989 | Schwartz et al. | 108/144 |
| 5,535,972 | 7/1996 | Fallago | 248/220.22 |

*Primary Examiner*—Leslie A. Braun
*Assistant Examiner*—Tan Le

[57] ABSTRACT

A support post and work surface support bracket attaches to a horizontal channel of office panels frame to provide a convenient variable height work suffice support at any point along the length of the panel frame. The post preferably has a tube as the main component thereof and slots are provided in the tube for receiving hooks on the work surface support bracket.

5 Claims, 4 Drawing Sheets

FIG. 1.
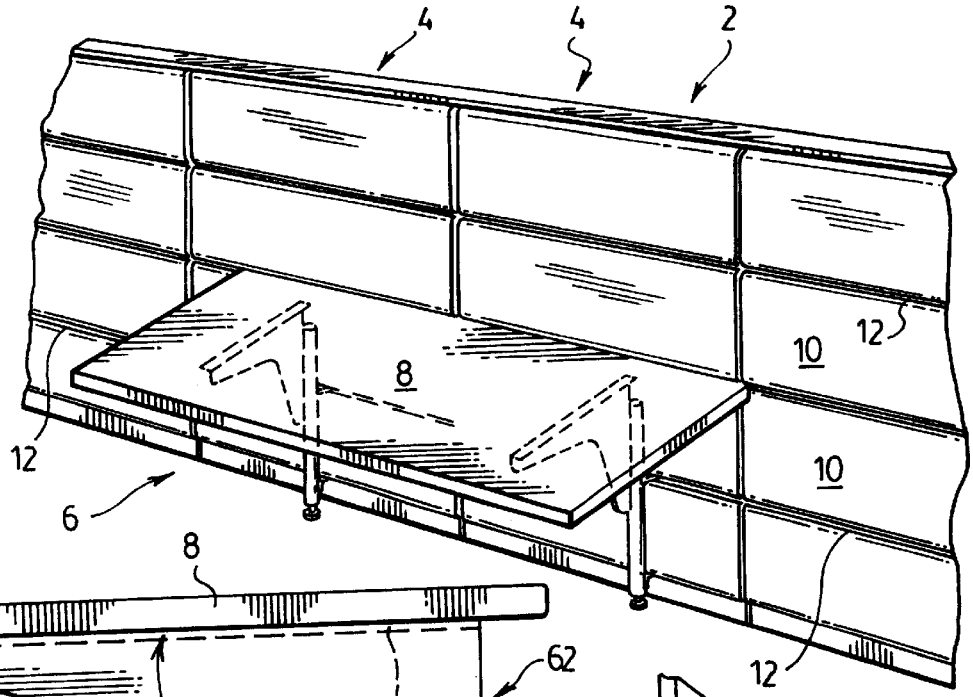
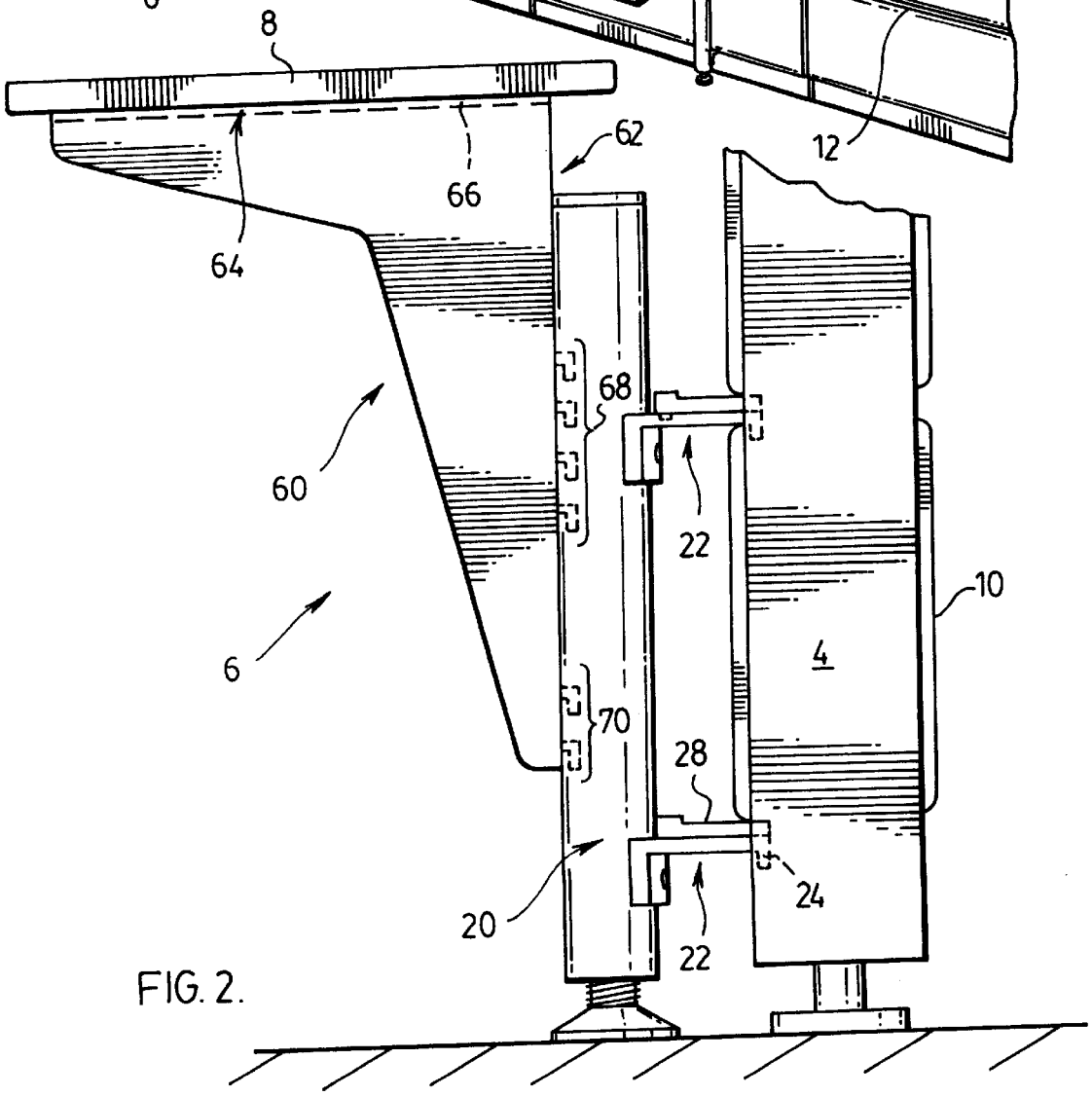
FIG. 2.

64
66

62
71
42
30
40
28
22
32
60
68
24
34
25
24
26
24
14
41
41
70
4
20
6
52
50
14

WORK SURFACE SUPPORT ARRANGEMENT FOR OFFICE PANELLING SYSTEMS

FIELD OF THE INVENTION

The present invention relates to a support arrangement for supporting a work surface from an office panelling system.

BACKGROUND OF THE INVENTION

Office panelling systems are now well established and provide a valuable system for subdividing an open office space into a series of work stations and open area to collectively define a good working environment. With office panelling systems it is possible to reconfigure the layout from time to time, however, it is a substantial undertaking to reconfigure the system particularly in cases where the panels provide power and communication wiring to the different work stations.

One advantage of office panelling systems is that they provide a framework to which work surfaces can be secured. Work surfaces traditionally have been supported by support brackets placed in a series of slots in vertical members of the office panel frame located opposite ends of the office panel. With this arrangement, the work surface is supported in a cantilevered manner from the office panels with the office panel frame defining the vertical support members.

Although this is a cost effective arrangement for providing work surfaces, it is not always convenient to support a work surface on-module, i.e. from the vertical members of a panel frame. U.S. Pat. No. 5,428,928 discloses a system where work surfaces are supported from an office panelling system in an off-module manner. The panelling system has a series of securing channels extending horizontally across the panels and these securing channels are accessible between the releasable elements of the office panel. The work surfaces can be height adjustable to accommodate the particular needs of a user. The structure shown in U.S. Pat. No. 5,428,928 works very well, however, it is somewhat complicated and expensive to manufacture. To provide height adjustment of the work surface, telescopic legs support the work surface. These telescopic legs are connected to a horizontal securing channel of the office panel with each leg spaced substantially outward from the office panelling system. This reduces the force exerted on the office panels as the leg acts as a spaced column support for the work surface and less force is carried by the office panel frame.

The present invention provides an effective arrangement for supporting work surfaces at variable heights from an office panelling system.

SUMMARY OF THE INVENTION

A work surface support arrangement for supporting work surfaces from an office panelling system, according to the present invention, comprises a support post and a work surface support bracket. The support post includes securing hooks extending from one side of the support post which securing hooks are releasably engageable with horizontal structural frame members of an office panel. A floor engaging levelling foot is provided at the base of this support post and a series of vertically aligned slots are provided in the support posts for releasable engaging securing members of the support bracket. The support bracket has a first edge with a plurality of post securing members for releasable engaging the slots in the post. The bracket includes a second edge for supporting a work surface. The series of slots in the support post allows securement of the bracket at different heights on the post and allows for fast adjustment of the height of the work surface supported by the work surface support arrangement.

According to an aspect of the invention, the support post has two series of slots rotationally separated approximately 90° about a vertical axis.

According to a further aspect of the invention, the securing hooks each have two securing sections rotationally separated approximately 90° about a vertical axis.

According to a further aspect of the invention, the support post is a tube.

According to yet a further aspect of the invention, each securing hook has a rotational cam member associated therewith for locking the respective hooks segment to a horizontal channel of an office panel frame.

BRIEF DESCRIPTION OF THE DRAWINGS

Preferred embodiments of the invention are shown in the drawings, wherein:

FIG. 1 is a partial perspective view showing a series of office panels connected in an end to end manner with a work surface to one side thereof;

FIG. 2 is a side elevational view of the work surface support arrangement attached to the frame of an office panel;

DETAILED DESCRIPTION OF THE PREFERRED EMBODIMENTS

Figure 3:
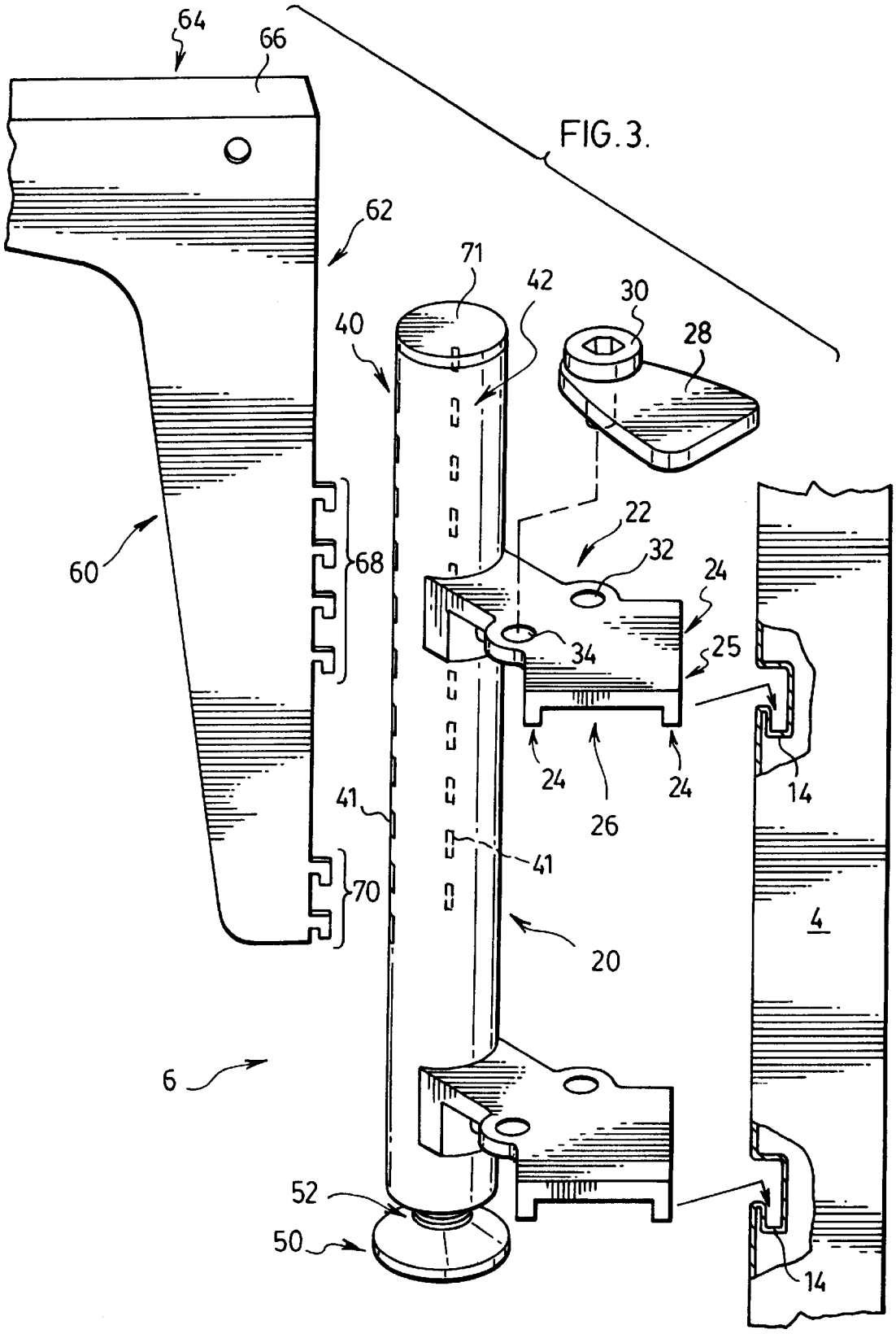
FIG. 3 is an exploded view showing securement of the work surface support arrangement to an office panel.

The office panelling system 2 of FIG. 1, has a series of connected office panels 4 from which a work surface 8 is supported by the work surface support arrangement 6. The office panels include an interior frame with releasable elements 10 secured to the exterior of the frame. Securement channels are accessible through the gap 12 between the elements 10. Details of the office panel frame are shown in U.S. Pat. Nos. 4,535,577 and 5,428,928 incorporated herein by reference.

As shown in FIGS. 2 and 3, the work surface support arrangement 6 includes a support post 20 attached to the spaced securing channels 14 of an office panel 4. The support post is connected to the securing channel by means of the securing hook 22, extending from one side of the post 20. Each securing hook 22 includes two hook segments with a first segment located along edge 25 and a second hook segment located along edge 24. Each edge 25 and 26 has two securing legs 24 clearly shown in the bottom view of FIG. 4. The two securing edges 25 and 26 allow the post to be orientated for left or right hand securement merely by rotating the post such that the appropriate edge is aligned with the securing channel 14 of an office panel. Each securing hook 22 includes a cam latch 28 which is forced into position by rotating the allen screw 30. This causes the bottom portion of the allen screw which is merely a post to freely rotate within the port 32 or the port 34 and jam the securing hook to a securing channel 14 as illustrated in FIG. 2. The cam latch engages a rear surface of the securing element forcing the legs into contact with securing channel while also fixing the vertical position of the securing hook in the channel.

Figure 4:
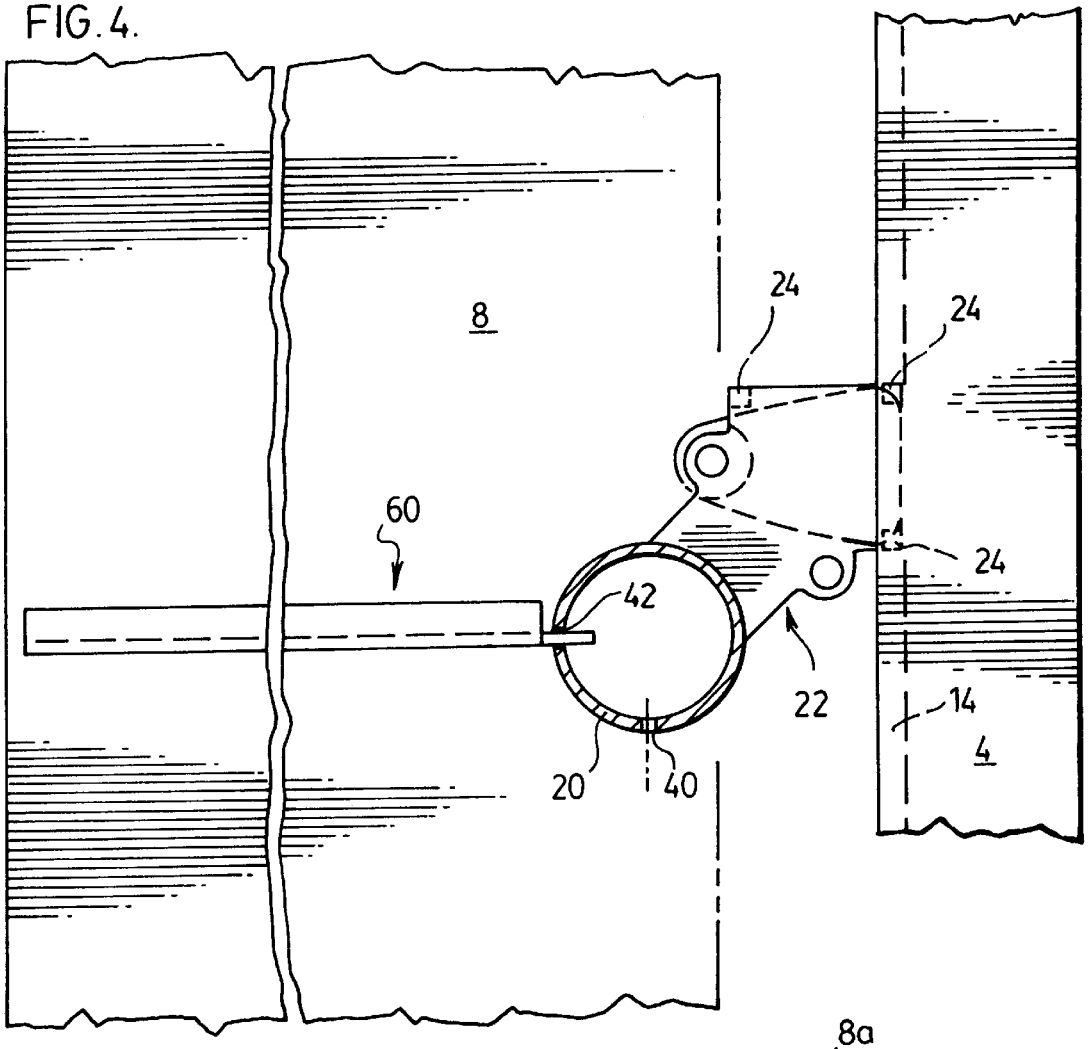
FIG. 4 is a bottom view showing securement of the post to an office panel as well as securement of the support bracket to a work surface.

The support post 20, as shown in FIG. 3 and 4, has two vertically aligned series of slots 40 and 42 with the individual slots being labeled as 41. These slots are 90° apart relative to a vertical axis of the post 20 and one set of slots is typically for use in association with the edge 25 and the other series of slots is associated with the edge 26. For example, slots 42 are normally used in association with the securing hook extension engaging a securing channel 14 allowing the edge 26 using the second hook segment.

The work surface support bracket 60 is generally "L" shaped and has a rear edge 62 with a first series of upper hooks 68 and a second series of lower hooks 70. These hooks are designed to cooperate with the vertically aligned slots 40 and 42. It can be appreciated that the bracket can be placed in different slots for defining a different height relationship of the bracket relative to the post 20. It should be noted that it is also possible to provide an upwardly directed hook on the bracket to act as a locking hook if desired where removal of the bracket requires a two step process which avoids accidental removal of the bracket.

The post 20 additionally includes an adjustable glide 50 having a screw thread 52. With this structure, the post can be secured to the channels 14 of an office panel 4 as shown in FIG. 3, and the glide at the base of the post can be adjusted to provide positive engagement with the floor. Forces transmitted from the work surface to bracket 60 and to the post 20 are transmitted through the post 20 to the floor via the glide 50 and partially through to the office panel 4 via the securing hook extensions 22 to the floor. The post 20 is located about 4" from the face of the office panel and thus is immediately adjacent the rear of the work surface. The post so positioned, does not provide a significant obstruction and it also cooperates with the office panel frame to provide twin column support for the work surface, i.e. the first column is the post 20 and the second column is the office panel frame. Furthermore, the work surface support arrangement 6 may be placed at any location along the securing channels 14.

A further advantage of this system is that the work surface support arrangement 6, as shown in FIG. 2, can be attached to the work surface 8 to leave a gap behind the work surface 8 and in front of the face of the office panel. This is convenient for allowing wires to be strung across the face of the panel. Wiring troughs can be provided at the rear of the work surface to allow the passage of wires and to store any excess wire. The wiring troughs can be attached to the work surface or to the office panel.

The use of the cam latch engaging the horizontal securing channels 14 allowing the leg to be off modular relative to the length of the panel is shown in our earlier U.S. Pat. No. 5,428,928, as well as a related U.S. Pat. No. 5,241,796 incorporated herein by reference.

Figure 5:
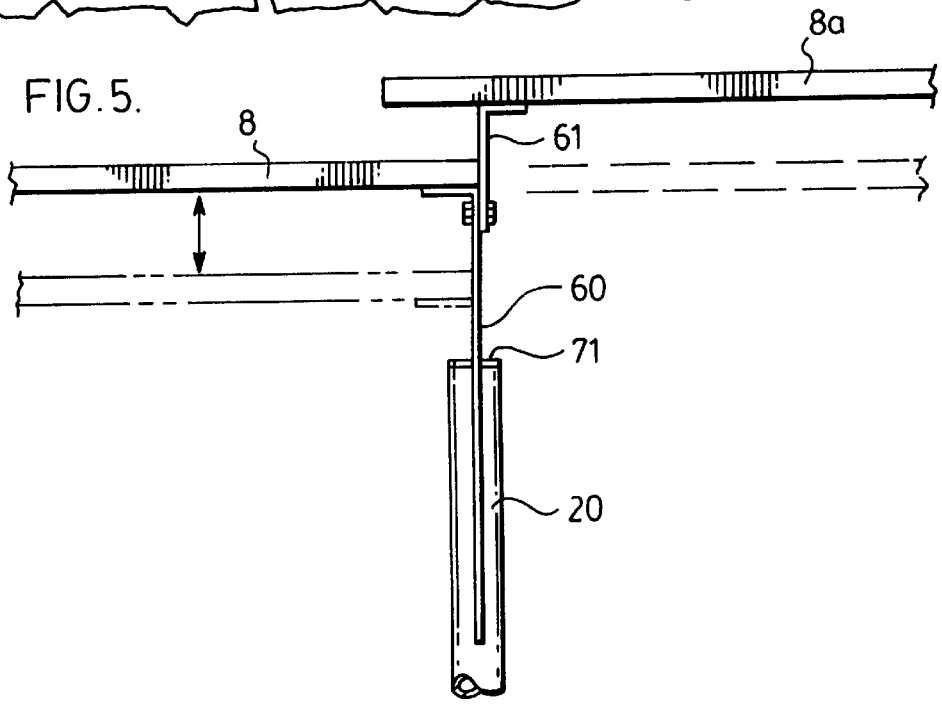
FIG. 5 is a partial front view showing a preferred aspect of the invention where a second bracket is attached to the work surface support bracket such that two work surfaces can be supported by a common post in an overall lapping relationship is shown in FIG. 5 or in a flush manner if desired.

A further aspect of the invention is shown in FIG. 5. In this case, the support post 20 supports the work surface 8 via the work surface support bracket 60 and supports an extension bracket 61 allowing the work surface 8A to be placed at a height above work surface 8 and overlapping therewith. Thus, bracket 60 provides support for both work surfaces 8 and 8A at different heights. It is also possible for the bracket 61 to be horizontally aligned with bracket 60 such that work surface 8 and 8A are flush. In this case, work surface 8A would have to shift towards the right to achieve a flush joint.

It has been found that the slotted post and cooperating hooked bracket provide a convenient, positive, cost effective arrangement for supporting work surfaces in a cantilevered manner from an office panelling system. The post can be inexpensively manufactured from tubing with the various slots punched in the post. The securing hooks 22 can be attached to the post by riveting or other suitable means. A glide is inserted in the base of the post and a cap 71 can be provided at the top of the post to provide a finished surface.

The securing post has been described with respect to its ability to support a work surface support bracket at various heights and transfer the force exerted on the work surface to the floor directly, or indirectly through the frame of the office panel. This structure also leaves the face of the panel above the lower two elements clear such that the upper elements can easily be removed if desired.

Figure 6:
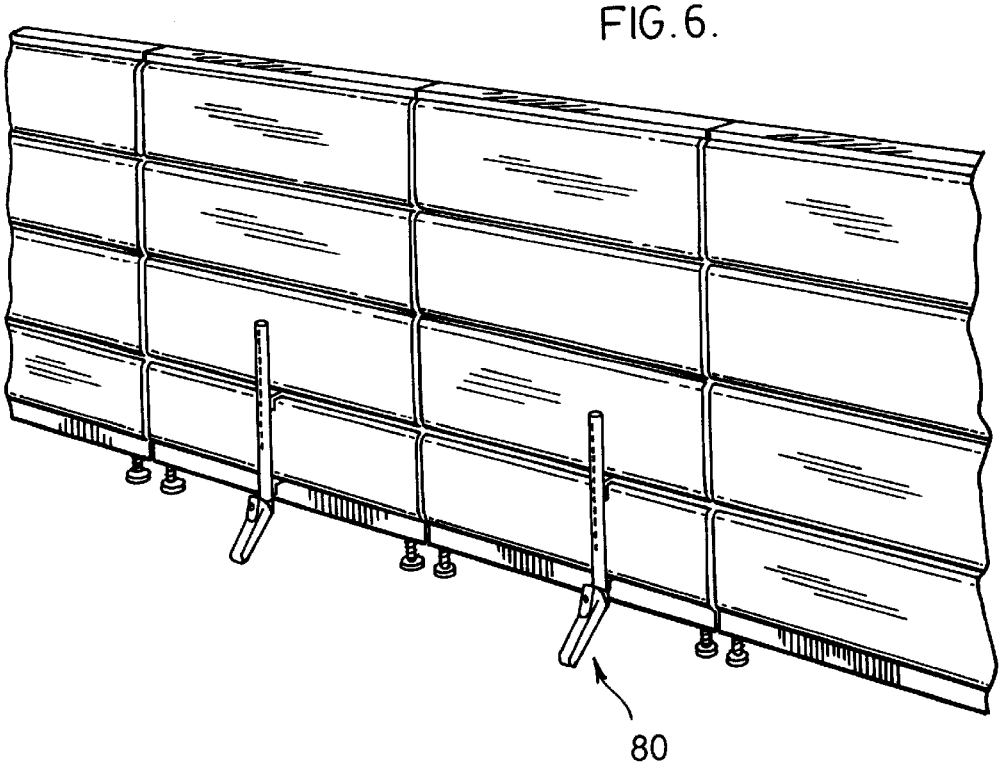
FIG. 6 is a partial perspective view of the office panelling system with a support post having a pivoting foot at the lower edge thereof.
Figure 7:
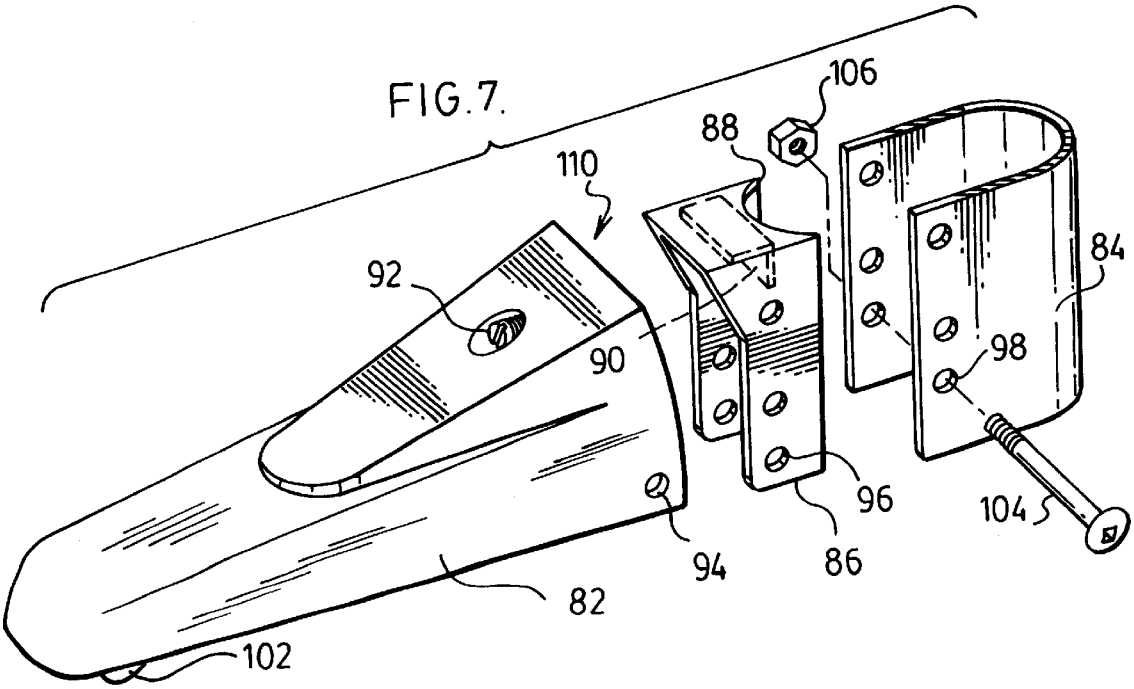
FIG. 7 an exploded perspective view showing the structure of the support foot arrangement.

The securing post can also be used to attach a support foot to an office panel at any point along the length of the panel to oppose racking of the panels. This is shown in FIGS. 6 and 7. The support post 20 is attached to the securing channels 14 of the office panel frame in the same manner as earlier described and distributes any loads to the securing channels with the post acting as a vertical reinforcing member. The support foot arrangement 80 includes a support foot 82 pivotally connected to the rear channel bracket of 84 which sleeves a lower portion of the support post 20 and is attached thereto by securement of the front bracket 86 to the rear channel bracket 84. The upper two ports in each side of the rear channel bracket and front bracket allow fasteners to draw the rear channel bracket and front bracket into tight engagement about the post. Port 98 in the rear channel bracket 84 and port 96 in the front bracket as well as port 94 in the foot co-operate with the bolt 104 and the nut 106 to pivotally attach the support foot 82 to the rear channel in a manner to allow pivoting of the foot about the axis defined by the bolt 104. The rear channel bracket 84 and the front bracket 86 can be separately placed on the lower end of the support post 20 when the support post is already attached to an office panel. In such a case, the rear bracket channel 84 is first placed about the lower end of the post and then positioned to have the open part of the rear channel bracket face forwardly. The front bracket 86 is then brought into appropriate position and mechanically fastened to the rear channel bracket. Fastening of the rear channel bracket and the front bracket bring these components into snug engagement with the lower end of the support post 20. The support foot 82 may then be attached to the rear channel bracket and front bracket by means of the bolt 104. As can be appreciated the support foot 82 is basically free to pivot in the vertical plane about the axis defined by the bolt 104. Once the support foot has been attached, the adjusting screw 92 is tightened, forcing the end of the adjusting screw to contact the "L" shaped bracket 90 which is immediately in front of the support post. This bracket serves to distribute the load exerted by the adjusting screw 92 to the support post. Tightening of the adjusting screw 92 forces the foot to pivot downwardly and if there is any angling of the office panel towards the support foot (i.e. racking of the long spline of office panels) the panels can be brought back to their upright position and maintained in this position as the support foot opposes any angling of the office panels about their lower edge. A long spline of office panels may require a series of support feet. Normally this arrangement is used to provide additional support in an area where there is a large gap between panels at 90 degrees to the spline of office panels.

This support foot arrangement allows for convenient attachment of the foot to an office panel at any point along the length of an office panel. It can be appreciated that this may be at a point where a work surface terminates and a support post is already located. On the other hand, it may be at any point along a length of office panels where there has not been an office panel or other support arrangement at 90° or at an angle to the spline of the office panels. The foot arrangement can also be used to supplement the support for a work surface adjacent a panel or to support a work surface alone.

As shown in FIGS. 6 and 7, the rear face 110 of the support foot 82 is hollowed out to allow the pivoting of the support foot and overlap with the front bracket 86. This design of the support foot is very convenient in that the rear channel 84 and the front bracket 86 may be appropriately attached to the support post at the lower edge thereof at an appropriate level. The front of the support foot 82 is of a low profile and provides an unobtrusive front edge. The front of the support foot engages the floor at contact member 102. This is a curved member and thus the foot is supported at the front of the foot and at the rear of the foot. Often, the floor in an office building is not level and the pivoting foot allows for either downward angling of the support foot 82 or upward angling depending upon the particular circumstances of the floor and the placement of the office panel. This arrangement is in contrast to previous arrangements where a support foot is appropriately attached to slots in vertical columns at the edges of office panels and extends generally in a perpendicular manner from the office panel. An adjustable glide is provided at the front of the prior art support foot for levelling. With this prior art arrangement, the support foot does not have the desirable low profile provided by the present arrangement.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A work surface support arrangement supporting a substantially horizontal work surface from an office panelling system, said work surface support arrangement comprising an upright support post spaced outwardly and beside said office panelling system and a work surface support bracket; said support post including securing hooks extending from one side of said support post which releasably engage a horizontal structural frame member of an office panel of said office panelling system, and an adjustable floor engaging foot at the base of said support post; said support post including a series of vertically aligned slots in said support post for releasably engaging securing hooks of said support bracket; said support bracket having a first edge with a plurality of post engaging members in releasable engagement with said slots and a second edge engaging said work surface, wherein said series of slots of said support post allow securement of said bracket at different heights and allow fast adjustment of the height of a work surface supported by said support arrangement by securing said support bracket with appropriate slots of said support post.

2. A work surface support arrangement as claimed in claim 1 wherein said support post has two series of slots rotationally separated approximately 90° about a vertical axis.

3. A work surface support arrangement as claimed in claim 2 wherein said securing hooks each have two securing sections rotationally separated approximately 90° about a vertical axis.

4. A work surface support arrangement as claimed in claim 2 wherein said support post is a tube.

5. A work surface support arrangement as claimed in claim 2 wherein each securing hook has a rotational cam member associated therewith for locking the respective hook segment to a channel of an office panel.

* * * * *